US005777250A

United States Patent [19]

Aoyama et al.

[11] Patent Number: 5,777,250

[45] Date of Patent: *Jul. 7, 1998

[54] ELECTRONIC MUSICAL INSTRUMENT WITH SEMI-AUTOMATIC PLAYING FUNCTION

[75] Inventors: Toru Aoyama, Iwata; Mineo Kitamura, Hamamatsu; Yasushi Sato, Hamamatsu; Satoshi Fujimoto, Hamamatsu, all of Japan

[73] Assignee: Kawai Musical Instruments Manufacturing Co., Ltd., Shizuoka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 720,298

[22] Filed: Sep. 27, 1996

[30] Foreign Application Priority Data

Sep. 29, 1995 [JP] Japan ..... 7-275138
Sep. 29, 1995 [JP] Japan ..... 7-275139

[51] Int. Cl.[6] ..... G10H 7/00; G10H 1/36

[52] U.S. Cl. ..... 84/609; 84/604; 84/610; 84/616; 84/634

[58] Field of Search ..... 84/601–606, 609–613, 84/615, 616, 634–637

[56] References Cited

U.S. PATENT DOCUMENTS

| | | | |
|---|---|---|---|
| 4,633,751 | 1/1987 | Fukaya et al. | 84/1.03 |
| 5,367,121 | 11/1994 | Yanase | 84/666 |
| 5,561,256 | 10/1996 | Aoki et al. | 84/619 |
| 5,696,344 | 12/1997 | Fujimoto | 84/609 |

*Primary Examiner*—William M. Shoop, Jr.
*Assistant Examiner*—Marlon T. Fletcher
*Attorney, Agent, or Firm*—Christie, Parker & Hale, LLP

[57] ABSTRACT

In an electronic musical instrument, playing data are produced by depressing a key in a keyboard, and divided into plural groups. At least one of the semi-automatic playing channels processes sound data of a musical piece read out of a memory to generate musical tones in synchronism with the playing data of at least one group. The sound data may be corrected according to sound correcting data before being used to generate musical tones.

13 Claims, 7 Drawing Sheets

| MD | A-REGION | B-REGION |
|---|---|---|
| 0 | SEMI-AUTOMATIC PLAY (INDEPENDENT) | SEMI-AUTOMATIC PLAY |
| 1 | SEMI-AUTOMATIC PLAY (COMMON) | SEMI-AUTOMATIC PLAY |
| 2 | CHORD DATA INPUT | SEMI-AUTOMATIC PLAY |
| 3 | CHORD PROGRESS TIMING INPUT | SEMI-AUTOMATIC PLAY |

FIG. 9
| |
|---|
| EVENT READ POINTER |
| EVENT WRITE POINTER |
| SECTION VOLUME VALUE 1 |
| SECTION VOLUME VALUE 2 |
| ⋮ |
| SECTION VOLUME VALUE i |
| SECTION CUT-OFF VALUE 1 |
| SECTION CUT-OFF VALUE 1 |
| ⋮ |
| SECTION CUT-OFF VALUE j |
FIG. 14
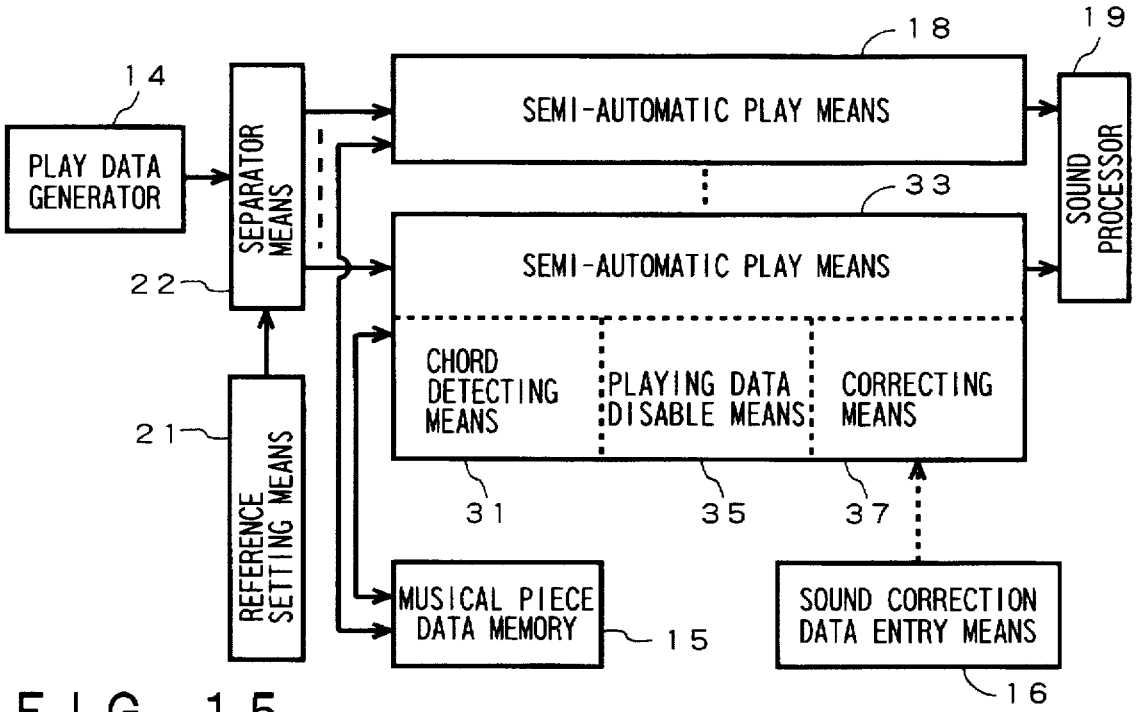
FIG. 15
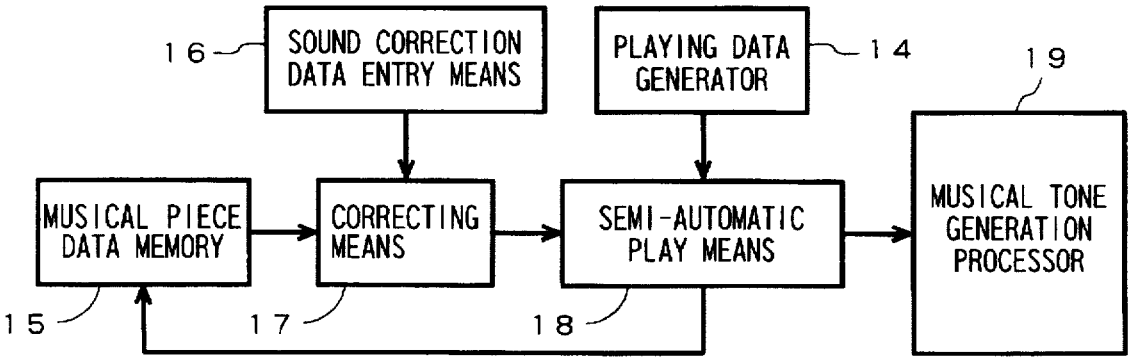

ELECTRONIC MUSICAL INSTRUMENT WITH SEMI-AUTOMATIC PLAYING FUNCTION

BACKGROUND OF THE INVENTION

1. Field of the Invention

The present invention relates to an electronic musical instrument with a semi-automatic playing function and particularly, to an electronic musical instrument with a semi-automatic playing function capable of semi-automatically playing a musical piece data in synchronism with depressing an arbitrary key and/or correcting musical sounds played semi-automatically.

2. Description of the Related Art

An electronic musical instrument with a semi-automatic playing function has been provided which in response to depressing an arbitrary key at specific timing, corresponding musical piece data stored in a memory are played in correct tones and pitches. Such a conventional musical instrument with a semi-automatic playing function allows tone information of its stored playing data to be sequentially emitted in the form of sounds in response to depressing an arbitrary key at predetermined timing. For semi-automatically playing both a melody part and an accompaniment part, a combination sound data including the melody part and the accompaniment part is semi-automatically played in response to depressing an arbitrary key at predetermined timing. The conventional electronic musical instrument with a semi-automatic playing function includes data of tone, volume, touch, pitch, and other acoustic effects which all are predetermined in its playing data, thus not permitting a player to make a change during the semi-automatic playing and/or not separating the melody part and the accompaniment part from each other by playing either of them semi-automatically.

SUMMARY OF THE INVENTION

It is a primary object of the present invention to provide an electronic musical instrument capable of semi-automatically playing any desired part of musical data.

It is another object of the present invention to provide an electronic musical instrument capable of correcting tones and changing effects provided during the semi-automatic playing.

In a first embodiment of the present invention, a playing data generating means produces a playing data in response to an action on a playing controller, a musical piece data memory means stores musical piece data comprising a series of musical sound data units, a separating means divides the playing data into a plurality of groups according to a predetermined reference, and at least one semi-automatic playing means reads in a sequence the sound data of the musical piece data out of the musical piece data memory means to process the sound data for generating musical tones in synchronism with the playing data of at least one group.

More particularly the accompaniment data is read out in response to the first group of the playing data and melody data is read out in response to the second group of the playing data.

The semi-automatic playing means may comprise a first semi-automatic playing means responsive to the playing data of the first group for reading, in a sequence, the sound data out of the musical piece data memory means and for processing to generate musical tones, and a second semi-automatic playing means including a chord detecting means responsive to the playing data of the second group for detecting a chord and a correcting means for correcting the pitch of the sound data corresponding to the chord detected.

The first embodiment may further comprise a sound correcting data entry means for entering a sound correcting data, and a correcting means for correcting the sound data read out according to the sound correcting data, whereby a semi-automatic playing means performs a playing of the corrected sound data.

In a second embodiment of the present invention, a playing data generating means produces a playing data in response to an action on a playing controller, a musical piece data memory means stores a musical piece data which comprises a series of musical sound data units, a semi-automatic playing means responses to the playing data for reading in a sequence the sound data of the musical piece data and for processing the sound data to generate musical tones, a sound correcting data entry means enters a sound correcting data, and a correcting means corrects the sound data read out according to the sound correcting data, whereby the semi-automatic playing means performs a playing of the sound data corrected.

BRIEF DESCRIPTION OF THE DRAWINGS

FIG. 9 is a diagram of a structure of data used in a second embodiment of the present invention;

FIG. 14 is a functional block diagram showing the first embodiment of the present invention; and FIG. 15 is a functional block diagram showing the second embodiment of the present invention.

DETAILED DESCRIPTION OF THE PREFERRED EMBODIMENTS

Figure 1:
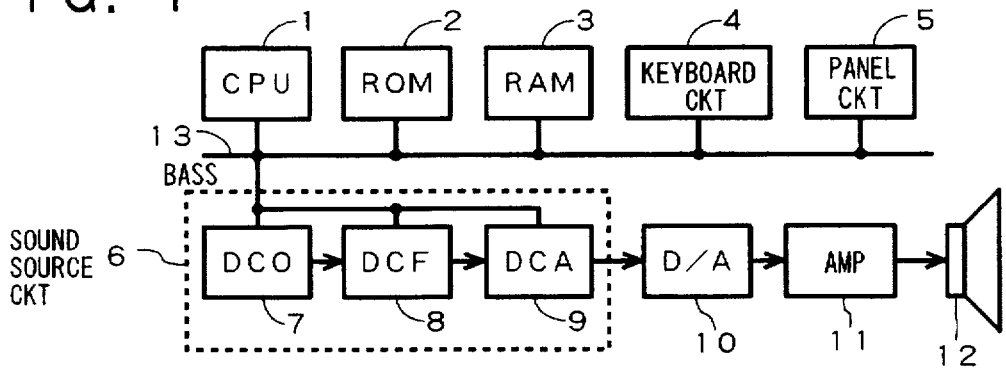
FIG. 1 is a block diagram of a hardware arrangement showing a first embodiment of the present invention.

The first embodiment of the present invention will be described in more detail referring to the accompanying drawings. FIG. 1 is a block diagram of an arrangement according to the first embodiment in which a CPU 1 includes a timer circuit for producing interrupts at intervals of a predetermined time and controls the electronic musical instrument according to control programs stored in a ROM 2. The ROM 2 saves musical piece data described later in detail as well as tone parameters, frequency information tables, and the programs. A RAM 3 is utilized as a work area and a buffer and holds a panel condition or the like. The memories may be backed up by a battery.

A keyboard circuit 4 serving as a player unit or a control element includes a keyboard carrying a plurality of keys, each key having, for example, two switches, and a scanning circuit for scanning the states of the switches of their respective keys, and when a change of the switch state is detected, producing a play information signal such as a key-on, a key-off, or a touch action to interrupt the process of the CPU 1. A panel circuit 5 comprises a variety of switches for tone selection, mode selection and other selections, a group of wheel controllers, a circuit for detecting change of the states in the switches or wheels (e.g., variable resistors) and producing panel event information signals to interrupt the CPU 1, and a display (for example, of liquid crystal or LED) for displaying messages, images or the like.

A sound source circuit 6 comprises a DCO 7, a DCF 8, and a DCA 9, each circuit being controlled by the CPU 1. The DCO 7 may be a circuit for producing musical tone signals by a known waveform reading technique. The musical tone signals are read out from the waveform memory (e.g., ROM 2), which holds waveforms of digital musical tone data, in a sequence at intervals of address proportional to the pitches of sounds to be emitted before interpolated and delivered. The DCF 8 may be a digital filter for filtering the output signals of the DCO 7 with a frequency characteristic corresponding to the designated tones and sound effects. The DCA 9 may include an envelope signal generator circuit of which envelope signal output is multiplied by the output signal of the DCF 8. Although the sound source circuit 6 has a plurality of musical tone generator channels that simultaneously function there may be one single musical tone generator circuit only that performs a time-divisional multiplexing operation that produces a plurality of musical tone signals, respectively.

The digital musical tone signals are converted into analog signals by a D/A converter circuit 10, amplified by an amplifier 11, and emitted as a musical sound from a loud speaker 12. A bus 13 is provided for connecting the prescribed circuits to each other. The electronic musical instrument shown in FIG. 1 may also include a floppy disk drive circuit, a memory-card interface circuit, a MIDI interface circuit, and other relevant circuits if desired.

Figure 2A:
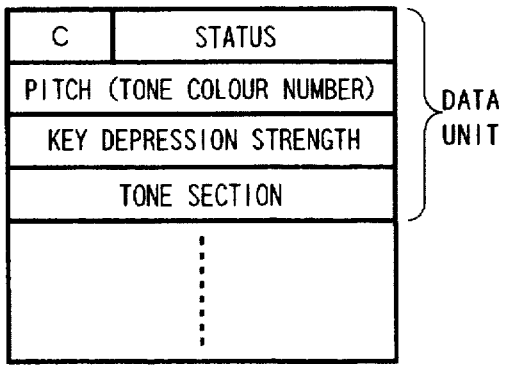
FIGS. 2A to 2D are diagrams respectively showing structures of data used in the first embodiment.

FIGS. 2A to 2D are explanatory diagrams showing formats of the musical piece data stored in the RAM 3 or ROM 2. FIG. 2A illustrates a format of a musical piece data semi-automatic play which comprises, for example, a series of 4-byte data units. The first byte in the data unit is a status byte indicating a type or sort of the data. It is assumed that "9" represents the start of sound emission (key-on), "8" is the end of sound emission (key-off), "12" the designation of the tone, and "0" an invalid data (no action). The invalid data may be used as timing blocks for emitting no musical tone or used to eliminate the processes for deleting the data made unnecessary during editing of the musical piece data and shortening the data length, by changing said data made unnecessary to invalid data. When a flag C in the most significant bit is "1", a next following sound data unit is to be processed simultaneously. If C=0, the next following sound data is to be emitted at the next predetermined timings.

The tone data (tone colour number) in the second byte is a key-number data when it is the start of sound emission; for example, "60" represents C3. In a case of the designation of tone, it is a tone number (type). The third byte saves a touch data or a key depression strength data at the start of sound emission mode. The fourth byte is a tone section data corresponding to, for example, a channel data in a MIDI signal. In a plurality of tone sections, tone numbers are respectively designated by the tone definition data. In the case of the start of sound emission, sounds are emitted in a tone colour according to the tone numbers defined in the tone sections.

Figure 2B:
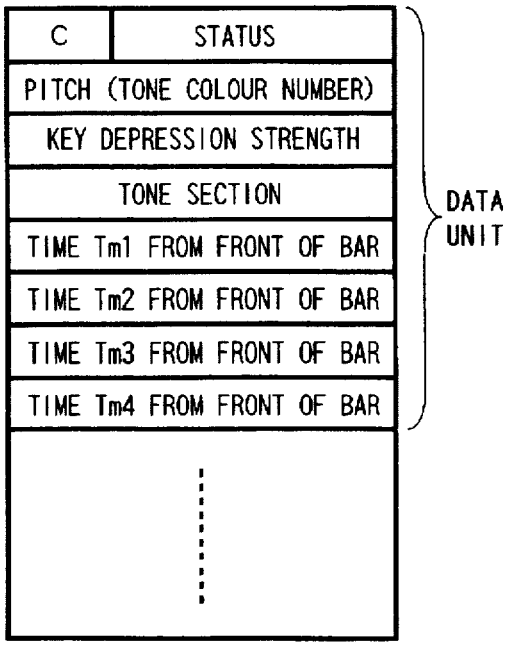

FIG. 2B shows a structure of a musical piece data for automatic play which may comprise a series of 8-byte data units. The first to fourth bytes in each data unit are identical to those of the semi-automatic musical piece data shown in FIG. 2A. The data unit may contain data representing bar marks (e.g., status 15) and/or end of pattern (e.g., status 127). The fifth to eighth bytes in FIG. 2B are lengths of time Tm from the front end of a bar (bar mark) to sound emission timing of the musical tone data. For automatic playing of an accompaniment part, the musical piece data which may include, for example, one to four bars of melody pattern for the accompaniment is played as their pitch are shifted according to a desired chord type inputted (which will be described later relating to Step S92). Upon reaching its end, the musical piece data is returned back to its start and repeatedly played.

Figure 2C:
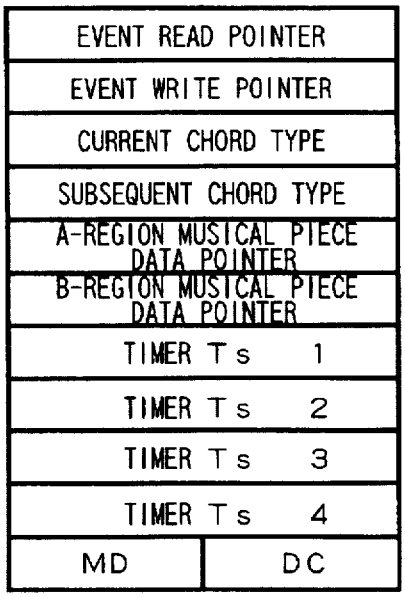

FIG. 2C shows a format of a system data. An event read pointer and an event write pointer in the format are, respectively, used for controlling an event queue buffer shown in FIG. 2D. A current chord type is the type of a chord for the bar which is being played. A subsequent chord type is the type of a chord for the succeeding bar. The chord types are specified by a player depressing keys in any of two divided regions (A-region and B-region ) of the keyboard as described later in detail relating to Step S50. An A-region musical piece data pointer and a B-region musical piece data pointer indicate locations (addresses or numbers) of the data units to be next played in the semi-automatic or automatic musical piece data shown in FIG. 2A or 2B, respectively.

Figures 7, 8:
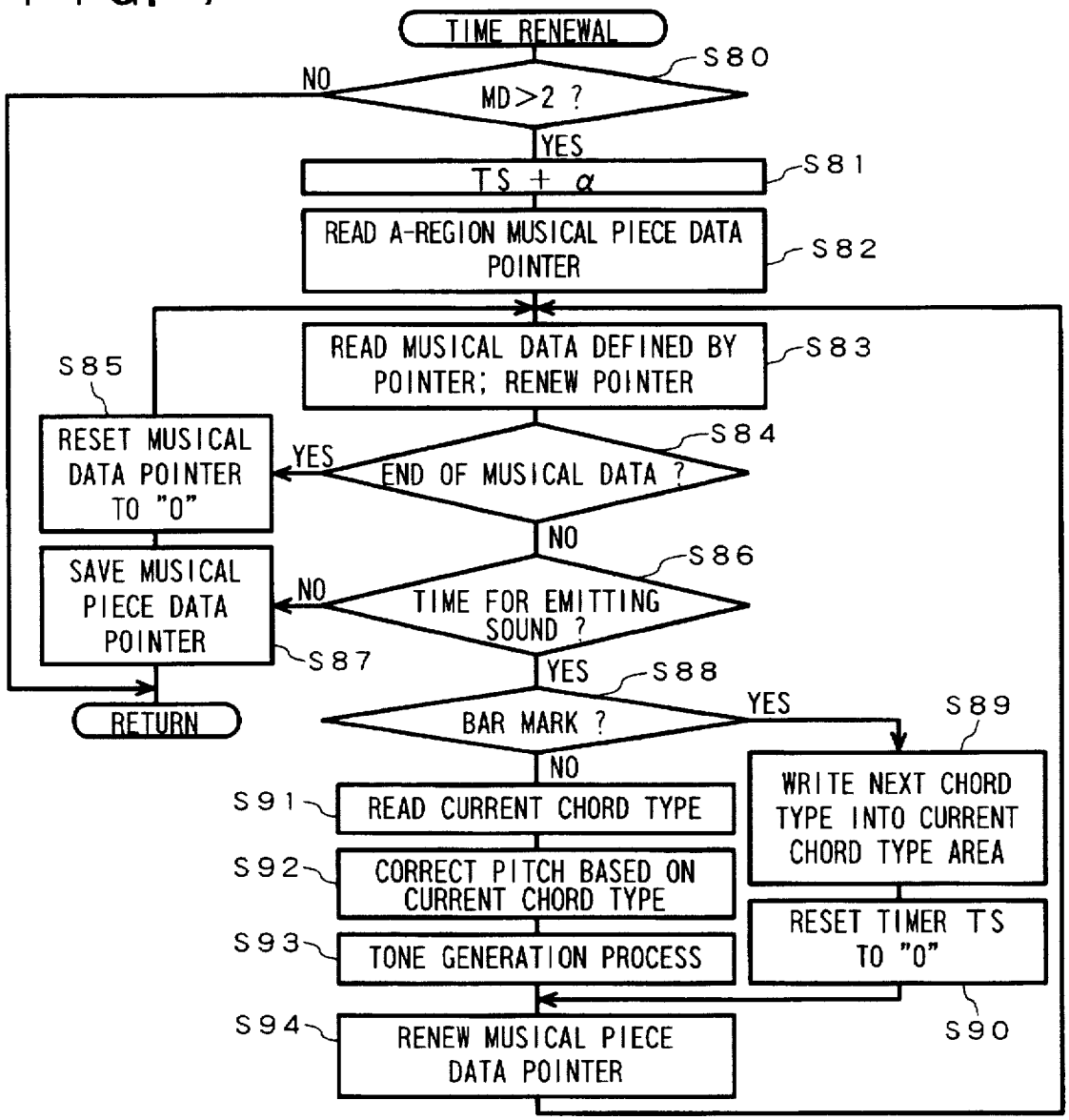
FIG. 7 is a flowchart of a time renewal process.
FIG. 8 is an explanatory view showing functions of the two regions in each mode.

Also, 4-byte timers Ts are provided for measuring the time from the start of the bar and determining the timings of emitting sounds of the musical piece data units in the automatic playing. They are cleared by bar mark data in the automatic musical piece data and incremented by a given length upon timer interruption. A direct call flag DC is used for identifying the source which has called for a corresponding event process routine. A mode flag MD is provided for indicating a key-division mode. The key-division mode includes 4 different modes 0 to 3 as shown in FIG. 8, each mode allocating the A-region of the keyboard with a specific function.

Figure 2D:
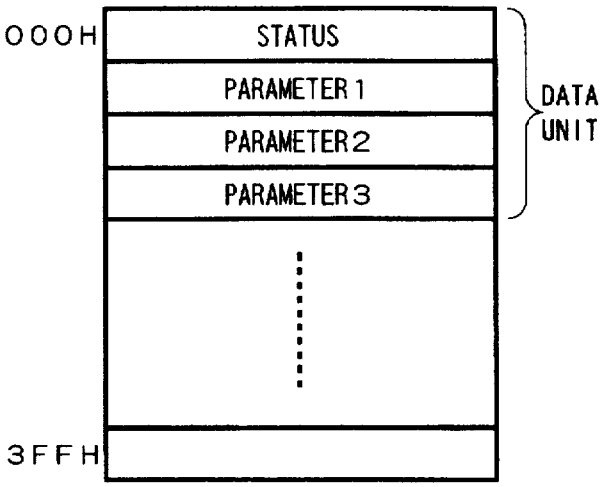

FIG. 2D illustrates a structure of the event queue buffer in which a plurality of 4-byte event data, respectively, comprising a status and parameters are stored during the interruption which will be described later referring to FIG. 4. The buffer volume may be, for example, 1 kilobytes. The structure (format) of the event data as key-on, key-off, and tone designation, is identical to those of the musical piece data units of FIG. 2A, while the status is updated with information indicative of either the A- or B-region in the keyboard.

Figure 3:
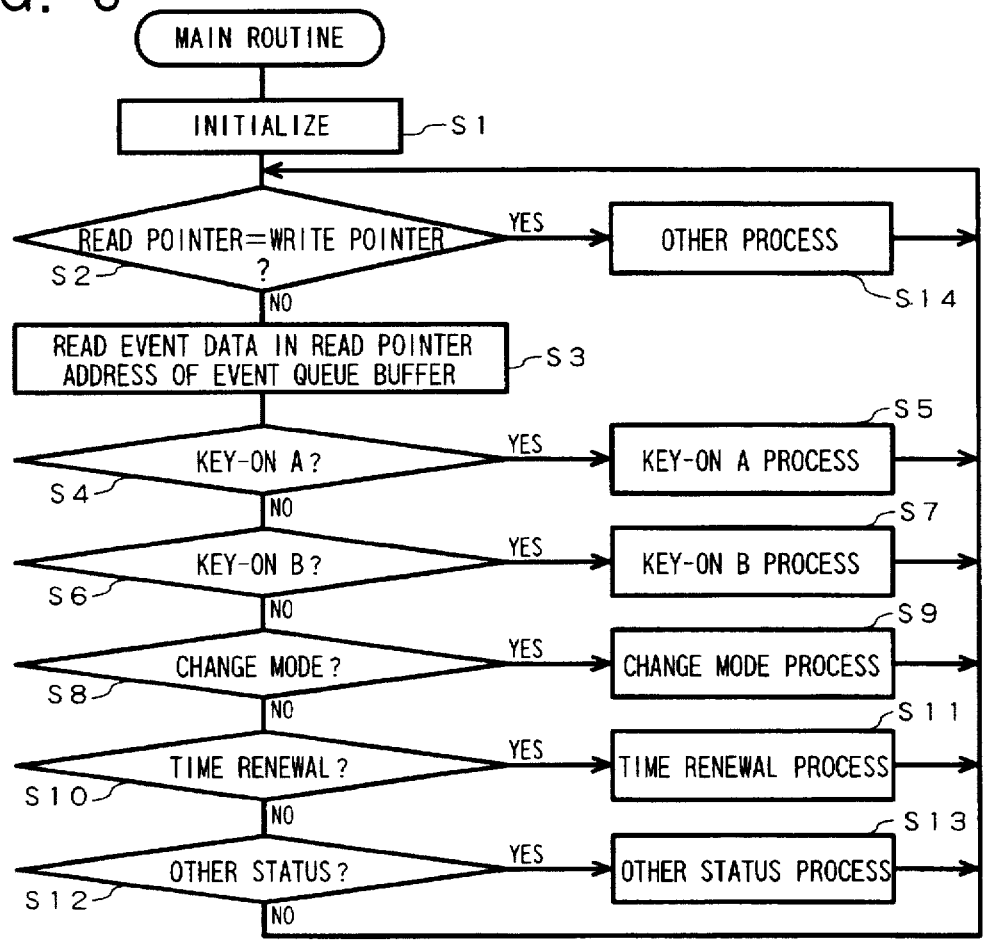
FIG. 3 is a flowchart of a main routine in a CPU (central processing unit) shown in FIG. 1.

FIG. 3 is a flowchart of a main routine in the CPU 1. When the electronic musical instrument is energized, the main procedure starts with initializing the data in the RAM 3 and the sound source circuit 6 at Step S1. This is followed by Step S2 where it is determined whether or not the event read pointer and the event write pointer are matched to each other in the system data of FIG. 2C. If not, the procedure goes to Step S3. When they are matched, it is judged that there is no events to be processed in the buffer and the procedure moves to Step S14 where any desired process such as a sound effect provision process or channel control during the sound emission is conducted.

At Step S3, the 4-byte event data (FIG. 2D) is read out at an address allotted by the read pointer in the event queue buffer and the read pointer is renewed. At Step S4, it is determined whether or not the status in the event data read out is a key-on A, i.e., the key-on in the A-region of the keyboard divided into two parts (for example, its key number being lower than a predetermined reference number). When it is affirmative, the procedure advances to Step S5 for executing the process of key-on A, described later with reference to FIG. 5. At Step S6, it is determined whether or not the status in the event data read out is a key-on B (for example, its key number being greater than the predetermined reference number). When it is affirmative, the procedure goes to Step S7 where the process of key-on B (FIG. 6A) is performed.

Figure 6A:
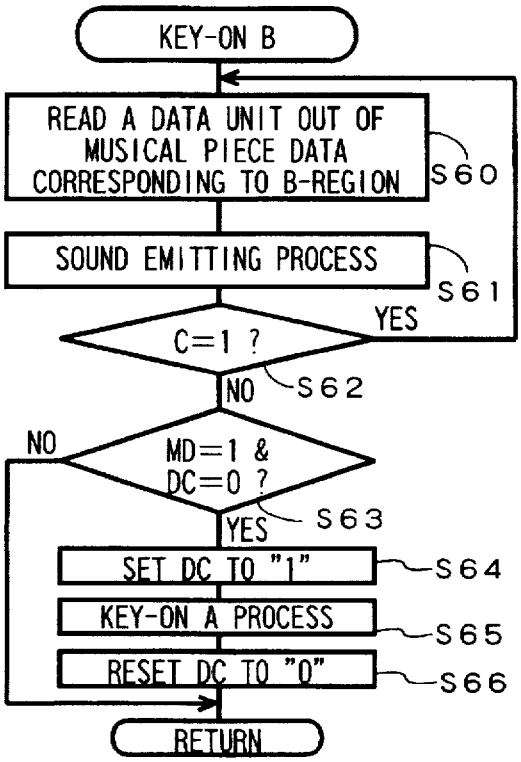
FIGS. 6A and 6B are flowcharts showing a key-on B process and a mode change process, respectively.
Figure 6B:
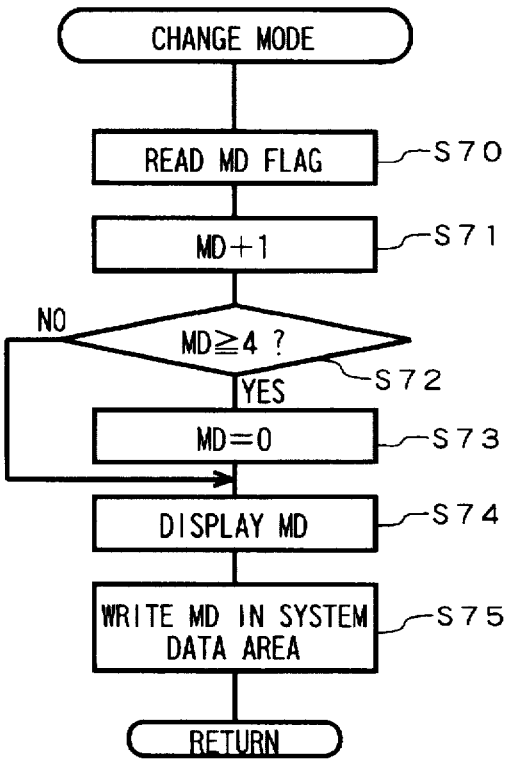

At Step S8, it is determined whether or not a status in the event data read out is a change mode. When it is affirmative, the procedure moves to Step S9 for executing the process of change mode (FIG. 6B). At Step S10, it is determined whether or not a status in the event data read out is a time renewal. When it is affirmative, the procedure advances to Step S11 where the time renewal is performed (FIG. 7). At Step S12, it is determined whether or not a status in the event data read out is another status (for example, a key-off or a tone colour definition). When it is affirmative, the procedure moves to Step S13 for executing other processes attributed to a status in the event read out. If not, the procedure returns back to Step S2 and the same steps are repeated.

Figure 4:
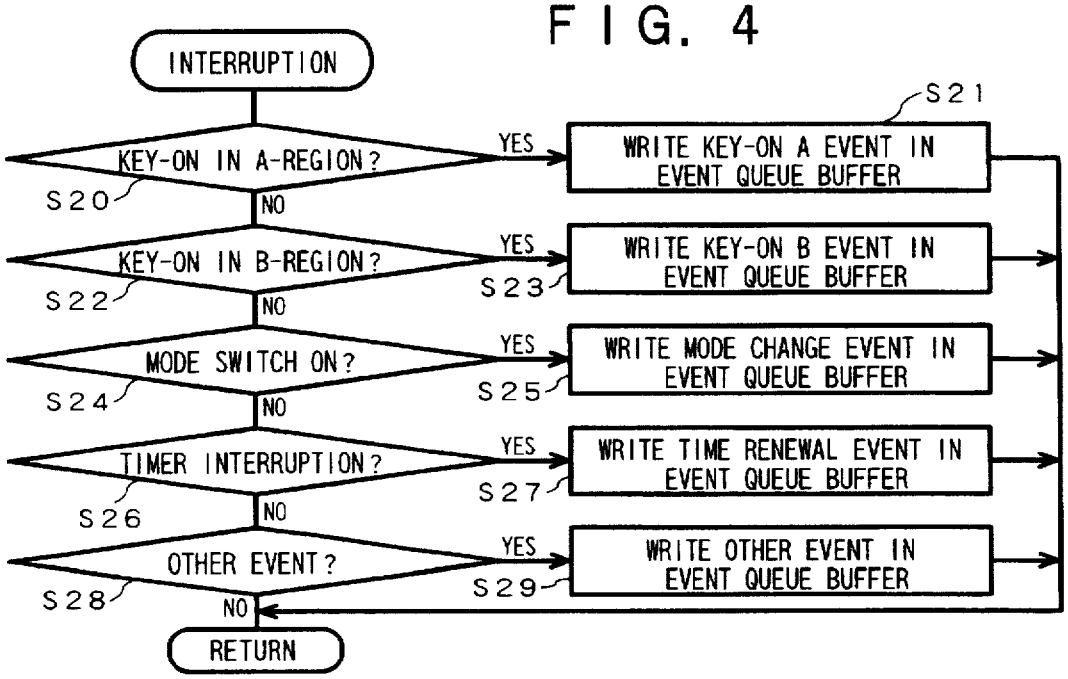
FIG. 4 is a flowchart of an interrupt process in the CPU.

FIG. 4 is a flowchart of a procedure of the interruption in CPU 1 which is carried on whenever the CPU 1 is interrupted by a signal from the keyboard circuit 4, the panel circuit 5, or the timer circuit built in the CPU 1. At Step S20, it is determined whether or not the interruption is caused by the A-region key-on. When it is affirmative, the procedure advances to Step S21 where the key-on A event data is written in the event buffer at an address defined by the write pointer, then the write pointer is renewed. At Step S22, it is determined whether or not the interruption is caused by the B-region key-on. When it is affirmative, the procedure moves to Step S23 where the key-on B event data is written in the event buffer at an address defined by the write pointer, then the write pointer is renewed.

At Step S24, it is determined whether or not the interruption is caused by the turning on of the mode switch for changing the mode MD. When it is affirmative, the procedure advances to Step S25 where the mode change event data is written in the event queue buffer. At Step S26, it is determined whether or not the interruption is caused by the timer interruption. When it is affirmative, the procedure moves to Step S27 where the time renewal event data is written in the event queue buffer. At Step S28, it is determined whether or not the interruption is caused by any other specific event. When it is affirmative, the procedure goes to Step S29 for writing said any other specific event (which is not directly related to the present invention but essential in general for the electronic musical instrument) in the event queue buffer. If not, the procedure returns back to the main routine.

Figure 5:
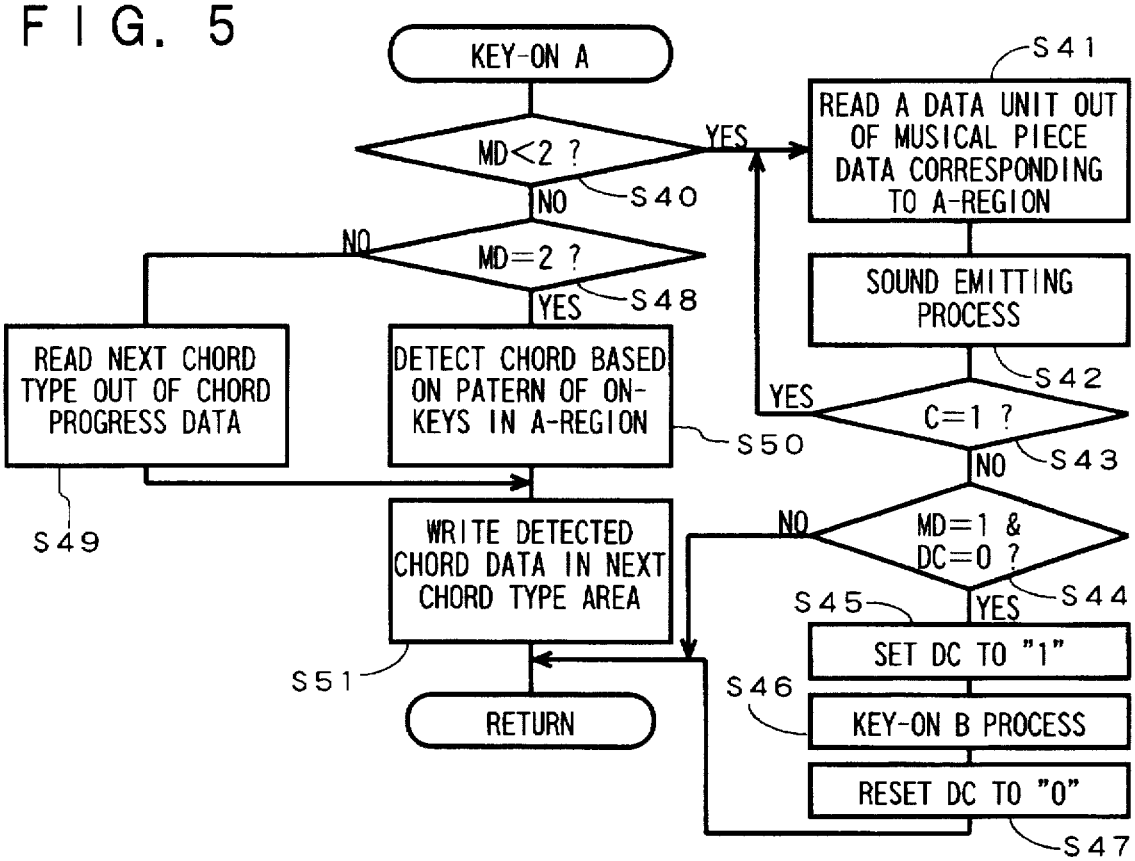
FIG. 5 is a flowchart of a key-on A process in the CPU.

FIG. 5 is a flowchart of a procedure of the key-on A of Step S5 which starts at Step S40 where it is determined whether or not the mode flag MD is less than "2" (that is "0" or "1"). When it is affirmative, the procedure goes to Step S41 for executing the semi-automatic playing. At Step S41, the data unit to be played subsequently is read out from the A-region musical piece data as shown in FIG. 2A according to the A-region musical piece data pointer. The data unit is then processed to emit its corresponding musical sound at Step S42. It is determined at Step S43 whether the flag C of the data unit is "1" or not. When it is affirmative, the procedure returns back to Step S41 for reading out the next succeeding data unit to emit a musical sound. If the flag C is "0", the procedure moves to Step S44 where it is determined whether MD=1 and DC=0 are given or not.

When the MD flag is "1", since it is a mode of no key division the process for the key-on B has to be turned on. DC=0 indicates that the current process is not called by the key-on B. When the judgement is affirmative at Step S44, the procedure goes to Step S45 where the flag DC is set to "1". At Step S46, the key-on B process shown in FIG. 6A is started. In the key-on B process thus started, as the flag DC has been set to "1" at Step S45, it is judged "no" at Step S63 of FIG. 6A and thus the key-on A process will never be executed again at Step S65. At Step S47, the flag DC is reset to "0".

When Step S40 determines negation, the procedure moves to Step S48 where it is determined whether MD is "2" or not. When it is affirmative, the procedure goes to Step S50. If not or MD=3, the procedure advances to Step S49. At Step S49, a next chord type corresponding to a value of the pointer (not shown) is read out of the predetermined chord progress data and stored. At Step S50, the chord type is detected on the basis of all key information of the key-on data in a given range (e.g., one octave) of the A-region. For example, when the A-region includes a low tone range below C1 (the key number 36) or C2 (the key number 48), the chord type can be selected by comparing a key depression pattern in one octave from C0 to C1 or C1 to C2 with the pre-stored chord patterns. At Step S51, the chord type selected or detected is written into the next chord type area in the system data (FIG. 2C). If no chord is detected at Step S50, Step S51 stays idle to return the main routine.

FIG. 6A is a flowchart of a procedure of the key-on B of Step S7 or S46. This procedure is substantially identical to Steps S41 to S47 of FIG. 5 except that the region A is replaced by the region B and will not be further explained.

FIG. 6B is a flowchart of a procedure of the change mode of Step S9. The flag MD is read at Step S70 and added with "1" at Step S71. It is determined at Step S72 whether or not MD is equal to or greater than 4. When it is affirmative, the procedure goes to Step S73 where MD is reset to "0". If not, the procedure is jumped to Step S74. The flag MD is displayed as the mode number on the panel 5 at Step S74 and saved in the system data area shown in FIG. 2C at Step S75.

FIG. 7 illustrates a procedure of the time renewal of Step S11. It is first determined at Step S80 whether MD is greater than "1" or not. When it is not, the procedure is ended to return to the main routine. If it is affirmative, the procedure goes to Step S81 where the timer Ts in the system data is updated with a given value alpha. The value alpha is a constant which is proportional to the interruption timer period. At Step S82, the data pointer for the A-region musical piece data pointer is read out of the system data. This is followed by Step S83 where the musical piece data unit defined by the data pointer determined at Step S82 is read out and the pointer is renewed. It is determined at Step S84 whether the musical piece data is finished or not. When it is affirmative, the procedure moves to Step S85 where the A-region musical piece data pointer is reset to 0. Then, the procedure is returned to Step S83 for repeating the musical piece data in the automatic playing.

At Step S86, it is judged whether or not the musical piece data unit has reached the time for emitting its sound. More specifically, this evaluation step is carried out by determining whether or not a value of the timer Ts in the system data is counted up to Tm from the start of the bar in the musical tone data unit. When it is affirmative, the procedure goes to Step S88. If not, the procedure moves to Step S87 for saving the musical piece data pointer into the system data and then is terminated.

It is determined at Step S88 whether or not the musical piece data unit read out is a bar mark. When it is affirmative, the procedure moves to Step S89. At Step S89, the succeeding chord type is selected from the system data and written into the current chord type area therein. The timer Ts is reset to 0 at Step S90 and the procedure advanced to Step S94.

If the evaluation in Step S88 is negative, the current chord type is read out at Step S91 and used at Step S92 for changing the pitch of the musical tone data unit. The change of the pitch may be done, for example, by correcting the pitch by a difference of key between the chord root and the musical piece data which are inputted, or by correcting the pitch of the music tone to be played to match the scale which has been determined according to the chord type such as a minor or seventh. Therefore, any known correcting method for pitch will be employed. At Step S93, the tone generation process is executed on the basis of the corrected tone data to emit the musical tone. This is followed by Step S94 where the musical piece data pointer is renewed (+8) before returning to Step S83 to repeat the process of the subsequent data unit.

According to the above steps, when the key-division mode flag MD is "0", depressing a pair of any desired keys, each in a bass part (the A-region ) and a treble part (the B-region ) of the keyboard, at a proper tempo causes semi-automatic playing of a melody and its accompaniment. If the mode is "1", depressing any one of desired keys or one key in either the bass part or the treble part of the keyboard at a proper tempo produces semi-automatic playing of a melody and its accompaniment. If the mode is "2", while the chord keys in the bass part of the keyboard are depressed in a sequence, any one of desired keys in the treble part is depressed at a given tempo. This allows semi-automatic playing of a melody with automatic playing of its accompaniment which is being corrected by the chord type data. If the mode is "3", while any arbitrary key in the bass part is depressed at the timing of a chord change, for example, at each of the bar marks, another arbitrary key is depressed at a given tempo. This operation allows semi-automatic playing of a melody with automatic playing of its accompaniment automatically corrected according to the chord progress which had been predetermined and stored.

This embodiment of the present invention may be modified as follows. Although the keys on the keyboard are divided into two halves by using a particular key as a reference or criterion for the playing data separation, a left half and a right half, in the embodiment, they may be divided into two groups of white keys and black keys on the basis of the colour of the key as a reference or criterion for the playing data separation. In this case, it is determined based on the key number at Step S20 whether or not the black key is turned on and at Step S22 whether or not the white key is switched on. The black keys are independent from each other and projected, hence being prevented from depression of two adjacent keys at once during the semi-automatic playing and thus variation in tempo is prevented. This also allows the player to play both a melody and its accompaniment with one hand.

It may be possible to use a combination of the left and right halves division and the black and white keys division. In this case, four different modes of the semi-automatic playing can be conducted simultaneously. During the playing, the black keys in the bass part may be enabled while the white keys are disabled. If two or more keys are depressed at a time in the semi-automatic playing, the timing of play will be impaired. This may be compensated by a playing data disabling means arranged for disabling any key-on action in the same region within a predetermined guard time which has started from the detection of the previous key-on.

Although the playing data are entered through the two regions of the keyboard in the embodiment, all the accompaniment pattern of a musical piece or all the chord progress and the accompaniment pattern of each single bars of the musical piece may be stored for full automatic playing relating to one region, for example, the A-region. In this case, the key-on events in the A-region are ignored or no key-division is made.

Although in the key-division mode of "3" only the timing of chord progress is entered in the embodiment, each note of the accompaniment pattern corrected by the chord type selected from the chord progress data may semi-automatically be played one by one similar to in the mode of "0".

In the key-division mode of "2" and "3", the chords detected or selected may be displayed on the panel. Although the timing of the chord type changing is when the bar mark is detected in the embodiment, the chord type may be renewed upon detections of the chord and the key-on in the modes of "2" and "3" (i.e., the process of Step S89 may be executed at Step S51).

Although any desired ones of the musical piece data can be allocated to the A- and B-regions, respectively, the melody and its accompaniment of each musical piece, for example, may be paired and stored in a list of titles of musical pieces and when any title is selected out of the list, its melody may be assigned to one (e.g., B) region and the accompaniment is assigned to the other (e.g., A) region.

The musical piece data for the automatic playing in the embodiment is differentiated only by the provision of the timing data Tm from the semi-automatic musical piece data and may be utilized for the semi-automatic playing. In this case, however, the bar mark and the key-off data are not needed for playing and should be ignored or disabled.

As understood from the above description and apparent from a functional block diagram of FIG. 14, the playing data produced by a playing data generating means 14 in response to the play operation on the player unit (keyboard) is divided into a plurality of groups by a separator means 22 according to a given condition derived from a condition setting means 21. In synchronism with at least one group of the playing data, the sound data are read out by a semi-automatic playing means 18 (and/or 33) in a sequence from at least one musical piece data stored in a musical piece data memory means 15, and emitted as a musical sound by a sound processor 19. If desired, the semi-automatic playing means 18 is provided with a chord detecting means 31 for detecting a chord on the basis of the playing data, and a correcting means 37 for correcting the pitch of the sound data according to the detected chord, and further a playing data disabling means 35 for disabling the subsequent playing data in the same group within a given guard time.

Therefore, a melody and its accompaniment are semi-automatically played independently, or one is played in a semi-automatic mode while the other is played in an automatic mode for ease of the player. The melody and the accompaniment may arbitrarily be modified in the timing of playing. When the keyboard is divided into two groups of the black keys and the white keys, the player can play two parts of a musical piece data in the semi-automatic mode using one hand. As the result, the first embodiment of the present invention allows any unskilled player or beginner to play a higher class of music with simple playing actions.

The second embodiment of the present invention will now be described in more detail referring to the drawings. It would be noted that the second embodiment is able to be applied to the first embodiment. A hardware arrangement of the second embodiment is substantially the same as that shown in the block diagram of FIG. 1. Also, the formats of semi-automatic musical piece data and event queue buffer data are substantially identical to those shown in FIGS. 2A and 2D.

FIG. 9 illustrates a structure of system data suited for the second embodiment of the present invention in which an event read pointer and an event write pointer are used for controlling the event queue buffer shown in FIG. 2D. As shown, the section volume value and the section cut-off value are provided for each tone group or "sections". Any specified data of these values can be modified using, for example, a corresponding wheel control. In the tone generation process for the semi-automatic playing, the volume (envelope) parameter assigned in the DCA 9 and the cut-off frequency parameter assigned in the DCF 8 are controlled according to the modified data.

Figure 10:
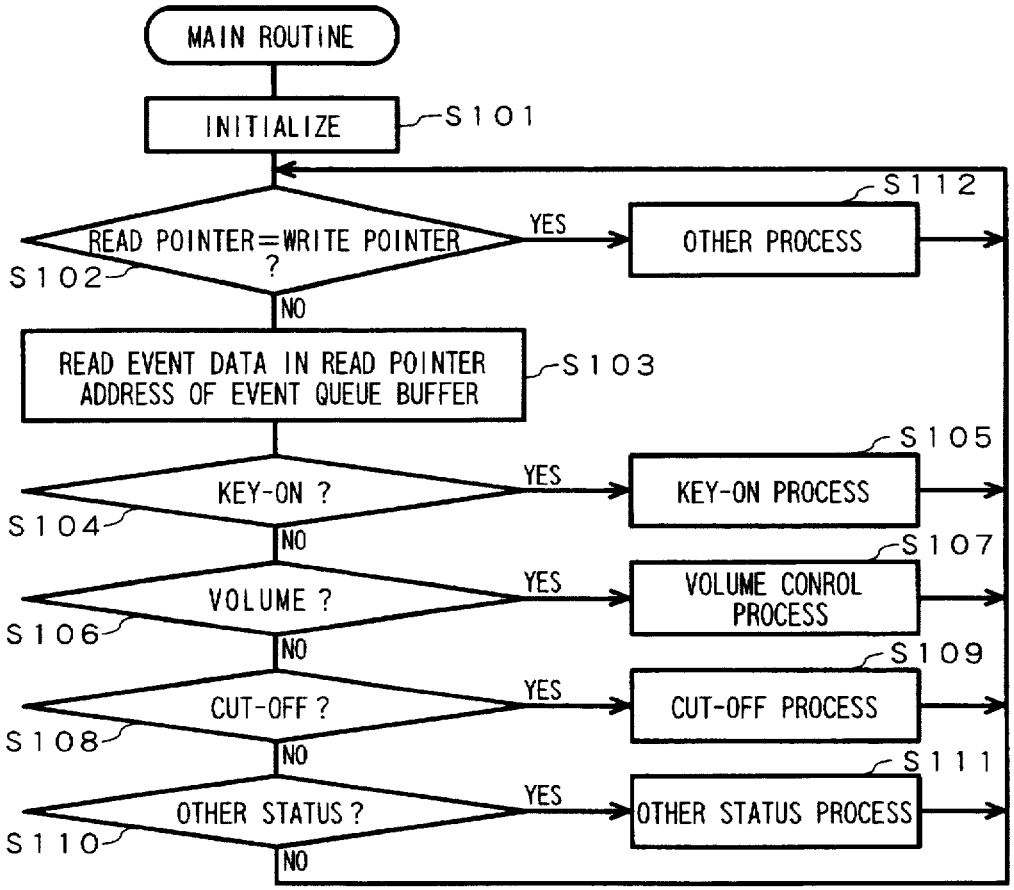
FIG. 10 is a flowchart of a main process in a CPU in a second embodiment of the present invention.

FIG. 10 is a flowchart of a main procedure in the CPU 1 in the second embodiment of the present invention, in which Steps S101 to S103 and S112 are identical to Steps S1 to S3 and S14 of FIG. 3.

Figure 12A:
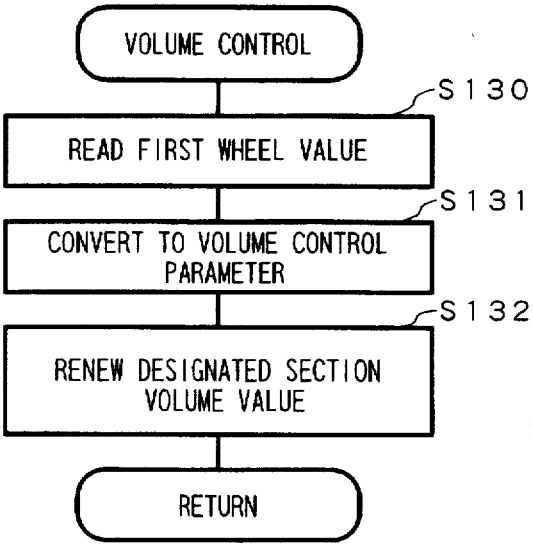
FIGS. 12A and 12B are flowcharts showing a volume process and a cut-off process, respectively.
Figure 13:
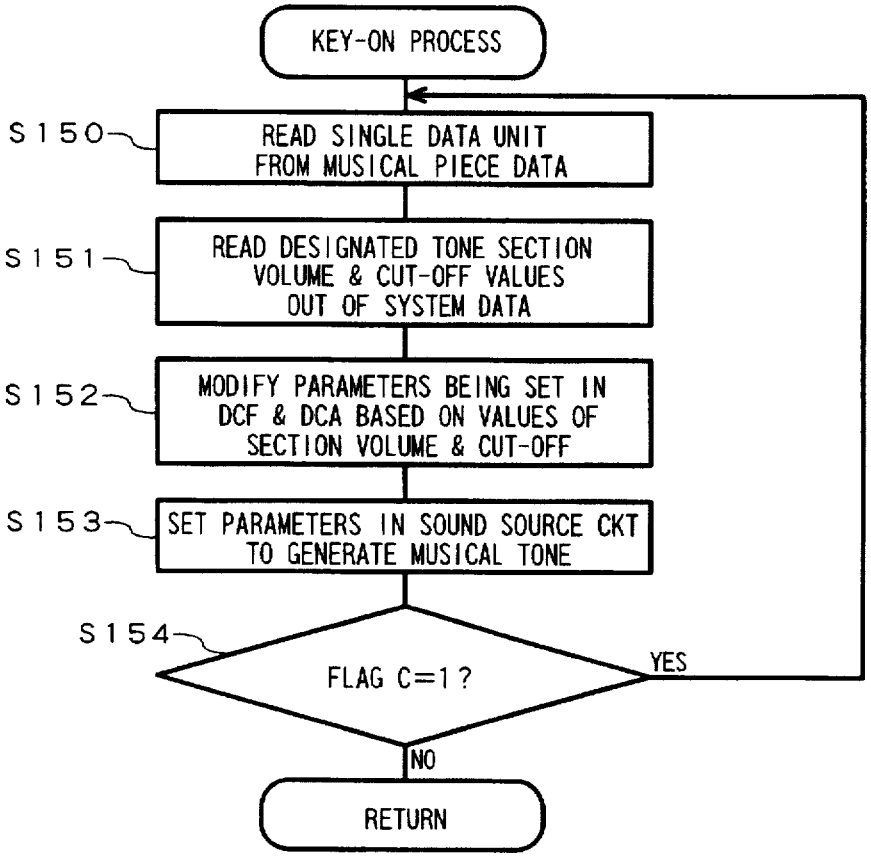
FIG. 13 is a flowchart of a key-on process.

It is determined at Step S104 whether or not the status of the selected event data is of key-on. When it is affirmative, the procedure goes to Step S105 where the key-on process is conducted as will be described later (FIG. 13). At Step S106, it is determined whether or not the status of the selected event data is of volume event. When it is affirmative, the procedure moves to Step S107 for executing the volume control as shown in FIG. 12A.

Figure 12B:
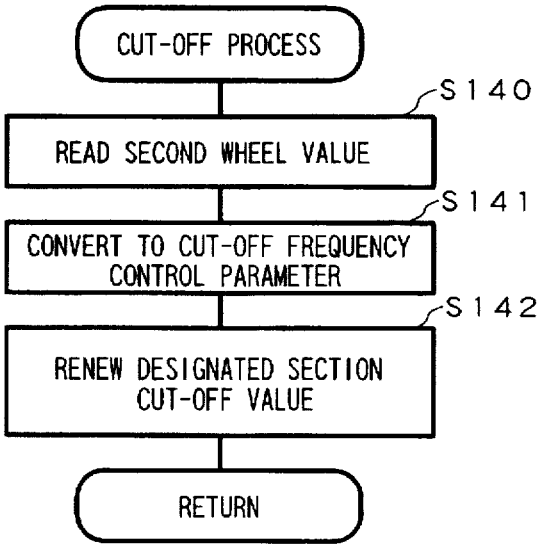

At Step S108, it is examined whether or not the selected event data is cut-off. When it is affirmative, the procedure goes to Step S109 where the cut-off process is conducted as will be described later (FIG. 12B). At Step S110, it is determined whether or not the status of the selected event data has any other requirement (for example, key-off or tone definition).

When it is affirmative, the procedure moves to Step S111 for carrying out the status process for said other requirement. If not, the procedure returns back to Step S102 and the same steps are repeated.

Figure 11:
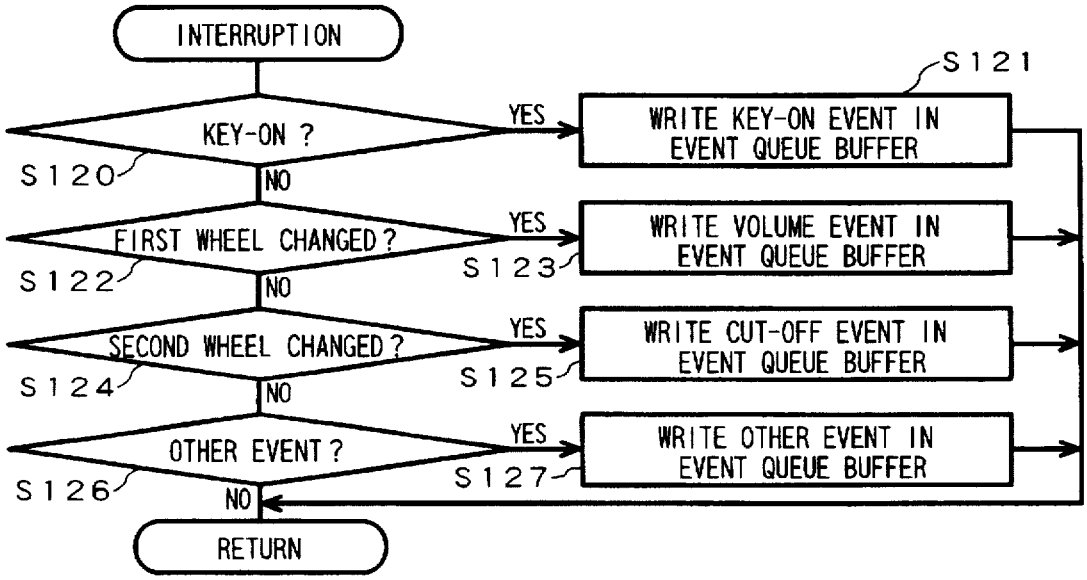
FIG. 11 is a flowchart of an interrupt process in the CPU in a second embodiment of the present invention.

FIG. 11 is a flowchart of a procedure of the interruption in the CPU 1. This procedure is started whenever the CPU 1 is interrupted by the keyboard circuit 4 or the panel circuit 5. It is determined at Step S120 whether or not the interruption is caused by a key-on action. When it is affirmative, the procedure goes to Step S121 where the key-on event is written into the event queue buffer at its address identified by the write pointer and the write pointer is renewed. At Step S122, it is determined whether or not the interruption is triggered by a change in the first wheel (not shown) for controlling the volume. When it is affirmative, the procedure moves to Step S123 where the volume event data including measurements (value) of the first wheel is written into the event queue buffer at its address identified by the write pointer and the write pointer is renewed.

At Step S124, it is determined whether or not the interruption is caused by a change in the second wheel (not shown) for modifying the cut-off value. When it is affirmative, the procedure moves to Step S125 where the cut-off event including measurements (value) of the second wheel is written into the event queue buffer. At Step S126, it is determined whether or not the interruption is triggered by another event. When it is affirmative, the procedure goes to Step S127 for writing the event into the event queue buffer.

FIG. 12A is a flowchart of a procedure for the volume control process in Step S107. The procedure starts with Step S130 where the measurements of the first wheel is read out of the event queue buffer. The measurements of the first wheel is then converted at Step S131 to an envelope or volume control parameter using a converting means (not shown) such as a conversion table. At Step S132, the volume control parameter thus converted is saved as a section volume of the predetermined section for renewal thereof. The section corresponding to the control wheel has been specified by the panel operation and its value may be varied as desired.

FIG. 12B is a flowchart of a procedure of the cut-off process of Step S109. At Step S140, the measurements of the second wheel is read out of the event queue buffer. The measurements of the second wheel is then converted at Step S141 to a cut-off frequency control parameter using a converting means (not shown) such as a conversion table. At Step S142, the control parameter thus converted is written as a section cut-off value of the predetermined section for renewal thereof.

FIG. 13 is a flowchart of a procedure of the key-on process of Step S105. A single data unit to be next played is selected at Step S150 from the musical piece data shown in FIG. 2A according to the contents of a data counter (not shown). At Step S151, the volume value and cut-off (frequency) value of the designated section or tone group in the data unit are read out from the system data (FIG. 9). The volume and cut-off values thus read out are used at Step S152 for modifying or altering the control parameters which are to be set in the DCF 8 and the DCA 9. At Step S153, the control parameters are transferred to the sound source circuit 6 for starting generation a musical tone. It is determined at Step S154 whether the flag C of the data unit read out at Step S150 is "1" or not. When it is affirmative, the procedure returns back to Step S150 for repeating the same steps for generating a succeeding tone according to a succeeding data unit.

According to the above procedures, the player during the semi-automatic playing can arbitrarily modify, for example, the volume and the cut-off frequency of the musical tone by controlling the first and second wheels.

The means for entering the tone data correcting instructions in the second embodiment is not limited to the wheel controls, but any conventional variable resistors, switches, footswitches, or particular keys of the keyboard may be used with equal success.

As apparent from the above description and as shown in a functional block diagram of FIG. 15, the electronic musical instrument of the second embodiment of the present invention comprises playing data generator means 14, a semi-automatic playing means 18 for reading, in a sequence, tone data in the musical piece data out of the musical piece data memory means 15 in response to the playing data, a sound correcting data entry means 16 for entering the sound correcting data through a corresponding controller, and a correcting means 17 for correcting the musical tone data processed in a musical tone generation processor 19 according to the sound correcting data. During the playing, therefore, the on/off action and depth of various sound effects including echo, reverberation, and tremolo as well as the tone (cut-off frequency), volume (touch), pitch, and other elements can be easily and arbitrarily controlled to enhance the quality of the music or the versatility of expression by the player manipulating the wheel controls. It should be understood that the present invention is applicable not only to keyboard instruments including an electronic piano but also to any other electronic musical instrument with a play unit or controller.

What is claimed is:

1. An electronic musical instrument comprising:

playing data generating means for production of playing data in response to an action on a playing controller;

musical piece data memory means for storing musical piece data comprising a series of musical sound data units;

separating means for dividing the playing data into a plurality of groups according to a predetermined reference; and at least one semi-automatic playing means responsive to each said production of playing data in at least one of the plurality of groups, for reading a sequence of sound data units of the musical piece data out of the musical piece data memory means, said sound data units which are read out being determined by the group that the playing data belongs to, and for generating musical tones on the basis of said sound data units which are read out in synchronism with the production of playing data.

2. An electronic musical instrument according to claim 1, wherein the musical piece data includes at least one of a melody part and an accompaniment part of a musical piece.

3. An electronic musical instrument according to claim 2, wherein accompaniment data is read out in response to a first said group of the playing data and melody data is read out in response to a second said group of playing data.

4. An electronic musical instrument according to claim 1 further comprising a disabling means operative, when said production produces playing data of one said group, for disabling subsequent said playing data of said one group received within a given guard time.

5. An electronic musical instrument according to claim 1, wherein the semi-automatic playing means comprises:

a first semi-automatic playing means responsive to the production of playing data of a first group for reading, in a sequence, the sound data units out of the musical piece data memory means and for generating musical tones based thereon; and a second semi-automatic playing means including a chord detecting means responsive to the production of playing data of a second group for detecting a chord and correcting means for correcting a pitch of the sound data corresponding to the chord detected.

6. An electronic musical instrument according to claim 1, wherein the playing controller is a keyboard of which playing data is separated into two groups according to the predetermined reference.

7. An electronic musical instrument according to claim 6, wherein the predetermined reference is that the playing data is related to either a white or a black key of the keyboard.

8. An electronic musical instrument according to claim 6, wherein the predetermined reference is that the playing data is related to either a treble or a bass part key of the keyboard.

9. An electronic musical instrument according to claim 5, wherein the first and second semi-automatic playing means perform respective semi-automatic playing in response to the production of playing data of each of two different said groups independently.

10. An electronic musical instrument according to claim 1, further comprising:

sound correcting data entry means for entering a sound correcting data; and correcting means for correcting the sound data unit read out according to the sound correcting data, whereby musical tones are generated on the basis of the corrected sound data.

11. An electronic musical instrument according to claim 10, wherein the sound correcting data corrects at least one of tone, volume, pitch, cut-off frequency, and depth of each musical effect in the sound data.

12. An electronic musical instrument according to claim I wherein the sound data units which are read out are decided independently of the production of playing data.

13. An electronic musical instrument according to claim 6 wherein the production of playing data is produced in synchronism with the playing of keys on the keyboard and the generation of said musical tones for said sound data units that are read out is generated in synchronism with the playing of the keys.

* * * * *